US008795017B2

(12) United States Patent
Ochiai

(10) Patent No.: US 8,795,017 B2
(45) Date of Patent: Aug. 5, 2014

(54) METHOD OF MANUFACTURING A SPARK PLUG ELECTRODE AND A SPARK PLUG

(75) Inventor: Satoru Ochiai, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 267 days.

(21) Appl. No.: 13/329,855

(22) Filed: Dec. 19, 2011

(65) Prior Publication Data

US 2012/0196498 A1 Aug. 2, 2012

(30) Foreign Application Priority Data

Jan. 27, 2011 (JP) ..... 2011-15292
Jun. 17, 2011 (JP) ..... 2011-134753

(51) Int. Cl.
*H01T 21/02* (2006.01)

(52) U.S. Cl.
USPC ..... 445/7

(58) Field of Classification Search
USPC ..... 313/141; 445/7
See application file for complete search history.

(56) References Cited

U.S. PATENT DOCUMENTS

| | | | | |
|---|---|---|---|---|
| 7,781,949 | B2 | 8/2010 | Kishimoto et al. | 313/143 |
| 2008/0122334 | A1 | 5/2008 | Kishimoto et al. | 313/141 |

FOREIGN PATENT DOCUMENTS

| | | | |
|---|---|---|---|
| JP | 4-294085 A | 10/1992 | H01T 13/20 |
| JP | 4-319283 A | 11/1992 | H01T 13/20 |
| JP | 4-337271 | 11/1992 | H01T 13/32 |
| JP | 2008-130463 | 6/2008 | H01T 13/20 |

OTHER PUBLICATIONS

Notification of Reasons for Refusal (dated Jan. 22, 2013) issued in connection with corresponding Japanese Patent Application No. 2011-134753, with English translation.

*Primary Examiner* — Britt D Hanley
*Assistant Examiner* — Brenitra M Lee
(74) *Attorney, Agent, or Firm* — Kusner & Jaffe

(57) ABSTRACT

A method for manufacturing electrodes for a spark plug that reduces manufacturing time. The method includes a supply step of supplying a workpiece to a die for extrusion forming, wherein the die has a supply hole and an extrusion hole located adjacent to the supply hole for forming the workpiece to have a predetermined cross-sectional shape. The supply hole has a cross section greater than a cross section of the extrusion hole. The method also includes a forming step of pushing the workpiece, supplied to the supply hole, through the extrusion hole so as to form the workpiece into a shape corresponding to the cross section of the extrusion hole. In the supply step, the workpiece is supplied such that a plurality of workpieces form a vertical line in the die.

10 Claims, 10 Drawing Sheets

METHOD OF MANUFACTURING A SPARK PLUG ELECTRODE AND A SPARK PLUG

FIELD OF THE INVENTION

The present invention relates to a method for manufacturing electrodes for a spark plug and a method for manufacturing a spark plug.

BACKGROUND OF THE INVENTION

In general, a spark plug used for an internal combustion engine, such as a gasoline engine, includes a center electrode, an insulator provided around the center electrode, a metallic shell provided around the insulator, and a ground electrode (also called "outer electrode") attached to the metallic shell so as to form a spark discharge gap in cooperation with the center electrode.

The ground electrode and the center electrode, which are components of the spark plug (hereinafter collectively referred as "electrodes") are manufactured through extrusion forming in which a starting material (workpiece) of the electrodes is passed through a die. More specifically, the manufacture of electrodes is performed through the steps of supplying a single workpiece to the die, pushing the workpiece by use of a punch so as to pass the workpiece through the die, removing the extruded workpiece (hereinafter called an "extrudate") from the die, and performing cutting work or the like. For example, see Japanese Patent Application Laid-Open (kokai) No. H4-319283 ("Patent Document 1") and Japanese Patent Application Laid-Open (kokai) No. H4-294085 ("Patent Document 2").

SUMMARY OF THE INVENTION

Problems to be Solved by the Invention

In the above-described conventional method for manufacturing electrodes for a spark plug, since supply of a workpiece to a die, extrusion forming, and removal of an extrudate are performed on a workpiece-by-workpiece basis, there has been room for shortening the time required for manufacture of electrodes.

The present invention has been conceived to solve the conventional problem mentioned above, and an object of the invention is to shorten the time required for manufacturing electrodes for a spark plug.

Means for Solving the Problems

The present invention has been conceived to solve, at least partially, the above problem and can be embodied in the following modes or application examples.

Application Example 1

A method for manufacturing electrodes for a spark plug comprising a supply step of supplying a workpiece, which is a starting material of an electrode, to a supply hole of a die for extrusion forming which has an extrusion hole for forming the workpiece to have a predetermined cross sectional shape, the supply hole being located adjacent to the extrusion hole and having a cross section greater than a cross section of the extrusion hole; and a forming step of pushing the workpiece, supplied to the supply hole, through the extrusion hole so as to form the workpiece into a shape corresponding to the cross section of the extrusion hole, the method being characterized in that, in the supply step, the workpiece is supplied such that a plurality of the workpieces W form a vertical line in the die.

In this method, in the supply step of supplying the workpiece, the workpieces are supplied such that a plurality of the workpieces form a vertical line in the die for extrusion forming. Therefore, manufacturing time can be shortened, as compared with the case where supply of the workpiece, formation of an extrudate through extrusion forming, and removal of the extrudate are performed on a workpiece-by-workpiece basis.

Application Example 2

A method for manufacturing electrodes for a spark plug according to Application example 1, wherein the forming step comprises a step of pushing an n-th workpiece via an m-th workpiece so as to perform extrusion forming on at least a portion of the n-th workpiece, the n-th workpiece being a workpiece supplied to the supply hole in an n-th operation cycle where n is a natural number, and the m-th workpiece being a workpiece supplied to the supply hole in an m-th operation cycle where m is a natural number greater than n.

In this method, extrusion forming is performed at least a portion of the n-th workpiece by pushing out the n-th workpiece via the m-th workpiece. Therefore, waste of the material can be reduced, and manufacturing cost can be reduced. In addition, it is possible to prevent decrease in the rigidity and service life of a jig (punch) used for extrusion, which decrease would otherwise occur when the length of the jig is increased.

Application Example 3

A method for manufacturing electrodes for a spark plug according to Application example 1 or 2, wherein the workpiece supplied to the supply hole includes a core and a cladding which covers at least a portion of the surface of the core.

This method can shorten the time required for manufacturing an electrode including a core and a cladding from a workpiece including a core and a cladding.

Application Example 4

A method for manufacturing electrodes for a spark plug according to Application example 3, wherein, at one end of the workpiece along a direction parallel to a direction in which the workpiece is supplied to the supply hole, an end face of the core is exposed from an end face of the cladding.

This method can mitigate biting between extrudates formed through extrusion forming, to thereby facilitate an operation of separating the extrudates from one another.

Application Example 5

A method for manufacturing electrodes for a spark plug according to Application example 3 or 4, wherein, in the supply step, the workpiece is supplied to the die from the side where the core is exposed.

This method prevents the core from narrowing on the front-end side thereof.

Application Example 6

A method for manufacturing electrodes for a spark plug according to any one of Application examples 1 to 5, wherein, the workpiece subjected to the forming step is discharged from an opening of the extrusion hole opposite the supply hole.

As compared with the case where a workpiece after extrusion forming (extrudate) is discharged from the opening of the extrusion hole on the side toward the supply hole, this method can prevent occurrence of problems associated with the extrudate (scraping of the surface and biting against a jig (pin)), which would otherwise occur at the time of discharge. In addition, this method can eliminate such a jig (pin). Moreover, this method can shorten manufacturing time and reduce manufacturing cost, because lubrication treatment is not required to be performed on the workpiece or the die.

Application Example 7

A method for manufacturing electrodes for a spark plug according to Application example 6, wherein the extrusion hole of the die has a cross section determined such that a distance OA between the centroid O of the cross section and a point A which is located on the circumference of the cross section differs from a distance OB between the centroid O and a point B which is located on the circumference of the cross section and differs from the point A.

This method can prevent occurrence of problems without performing lubrication treatment or the like and increase the degree of freedom in designing the cross section of the electrode, even in the case where the extrusion hole of the die has a non-circular cross section; that is, a cross section determined such that a distance OA between the centroid O of the cross section and a point A which is located on the circumference of the cross section differs from a distance OB between the centroid O and a point B which is located on the circumference of the cross section and differs from the point A, and therefore a problem is likely to occur when the extrudate is taken out.

Notably, the present invention can be practiced in various forms. For example, in the forms of a manufacturing method and a manufacturing apparatus for spark plug electrodes, a manufacturing method and a manufacturing apparatus for spark plugs, and spark plug electrodes or spark plugs manufactured by these methods or apparatuses.

DETAILED DESCRIPTION OF THE INVENTION

The present invention will next be described with reference to specific embodiments in the following order. A. Embodiment: A-1. Structure of a spark plug, and A-2. Method for manufacturing the ground electrode for the spark plug; and B. Modifications.

A. Embodiment

A-1. Structure of a Spark Plug

Figure 1:
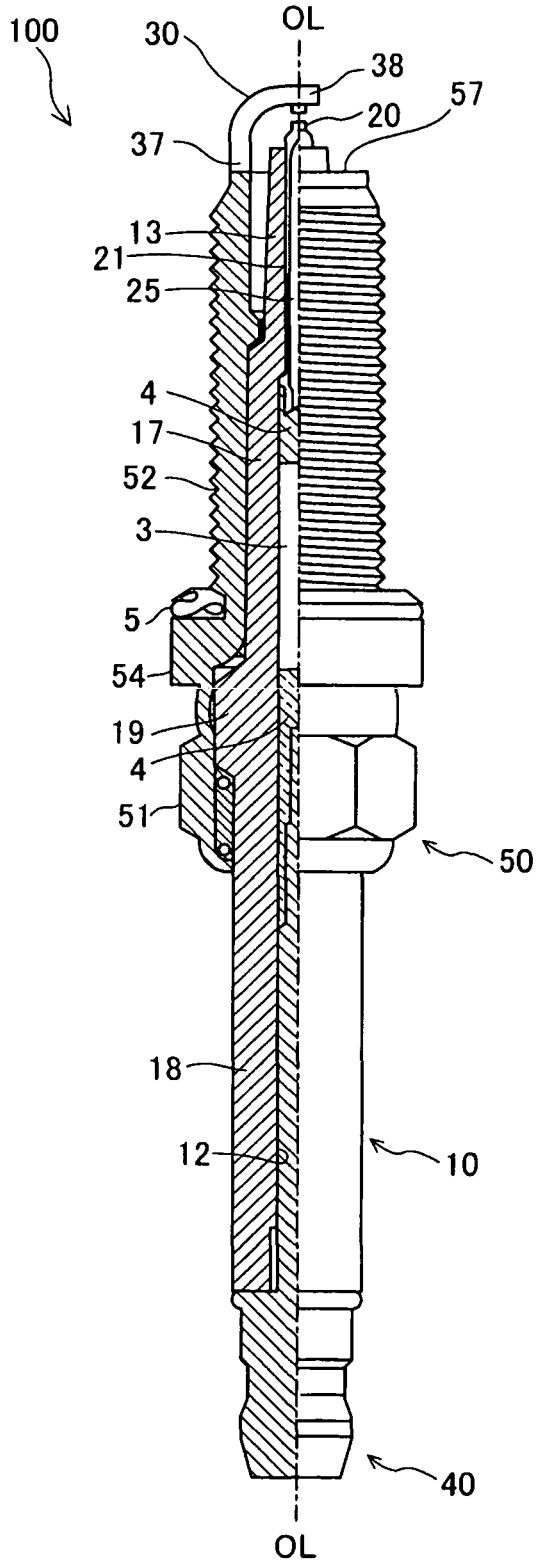
FIG. 1 is an explanatory view showing the structure of a spark plug 100 according to an embodiment of the present invention.

FIG. 1 is an explanatory view showing the structure of a spark plug 100 according to an embodiment of the present invention. In FIG. 1, the external view of the spark plug 100 is illustrated on the right side of an axis OL, which is the center axis of the spark plug 100, and a cross-sectional view of the spark plug 100 is illustrated on the left side of the axis OL. In the following description, the upper side along the axis OL in FIG. 1 (the side where a ground electrode 30 is disposed) will be referred to as the front-end side of the spark plug 100, and the lower side (the side where a metal terminal 40 is disposed) will be referred to as the rear-end side of the spark plug 100.

As shown in FIG. 1, the spark plug 100 includes an insulator 10, a center electrode 20, the ground electrode (outer electrode) 30, the metal terminal 40, and a metallic shell 50. The center electrode 20 is held by the insulator 10, and the insulator 10 is held by the metallic shell 50. The ground electrode 30 is attached to the front end of the metallic shell 50, and the metal terminal 40 is attached to the rear end of the insulator 10.

The insulator 10 is a tubular insulator which has an axial bore 12 formed therein at the center for accommodating the center electrode 20 and the metal terminal 40. The insulator 10 is formed from a ceramic material, such as alumina, by firing. The insulator 10 has a center trunk portion 19 formed at its axial center and having an outside diameter larger than those of the remaining portions. The insulator 10 has a rear trunk portion 18 located on the rear-end side of the center trunk portion 19 and adapted to establish electrical insulation between the metal terminal 40 and the metallic shell 50. Also, the insulator 10 has a front trunk portion 17 located on the front-end side of the center trunk portion 19. Furthermore, the insulator 10 has a leg portion 13 which is located on the front-end side of the front trunk portion 17 and is smaller in outside diameter than the front trunk portion 17.

The metallic shell 50 is a metal member which has an approximately cylindrical tubular shape and which surroundingly holds a region of the insulator 10 extending from a subportion of the rear trunk portion 18 to the leg portion 13. The metallic shell 50 is formed of metal such as low-carbon steel. The metallic shell 50 has a screw portion 52 having an approximately cylindrical tubular shape, and a thread is formed on the outer circumference of the screw portion 52. When the spark plug 100 is attached to an engine head, the thread is brought into screw-engagement with a threaded hole of the engine head. A front end surface 57, which is an end surface of the metallic shell 50 located on the front-end side thereof, is an annular surface. The distal end of the leg portion 13 of the insulator 10 projects from the center of the front end surface 57. Also, the metallic shell 50 has a tool engagement portion 51, with which a tool is engaged when the spark plug 100 is attached to the engine head, and a seal portion 54 which is formed on the rear-end side of the screw portion 52 and is formed into a flange shape. An annular gasket 5 formed through bending a plate is inserted between the seal portion 54 and the engine head. The tool engagement portion 51 has a hexagonal cross section, for example.

The center electrode 20 is a rodlike electrode having a structure in which a core 25 superior in thermal conductivity to a cladding 21 is embedded within the cladding 21 having a closed-bottomed tubular shape. In the present embodiment, the cladding 21 is formed of a nickel alloy which contains nickel as a main component. The core 25 is formed of copper or an alloy which contains copper as a main component. The center electrode 20 is inserted into the axial bore 12 of the insulator 10 in such a condition that the front end of the cladding 21 projects from the axial bore 12 of the leg portion 13 of the insulator 10. The center electrode 20 is electrically connected via a ceramic resistor 3 and a seal body 4 to the metal terminal 40 provided at the rear end of the insulator 10.

The ground electrode 30 is a rodlike electrode having a bent shape. A proximal end portion 37 (one end portion) of the ground electrode 30 is joined to the front end surface 57 of the metallic shell 50, and a distal end portion (the other end portion) 38 of the ground electrode 30 is bent to face the distal end portion of the center electrode 20. A gap (spark gap) for spark discharge is formed between the distal end portion 38 of the ground electrode 30 and the distal end portion of the center electrode 20. Notably, an electrode tip for improving resistance to, for example, spark erosion and erosion caused by oxidation may be provided on the side surface of the distal end portion 38 of the ground electrode 30, which surface faces the center electrode 20.

Figure 2:
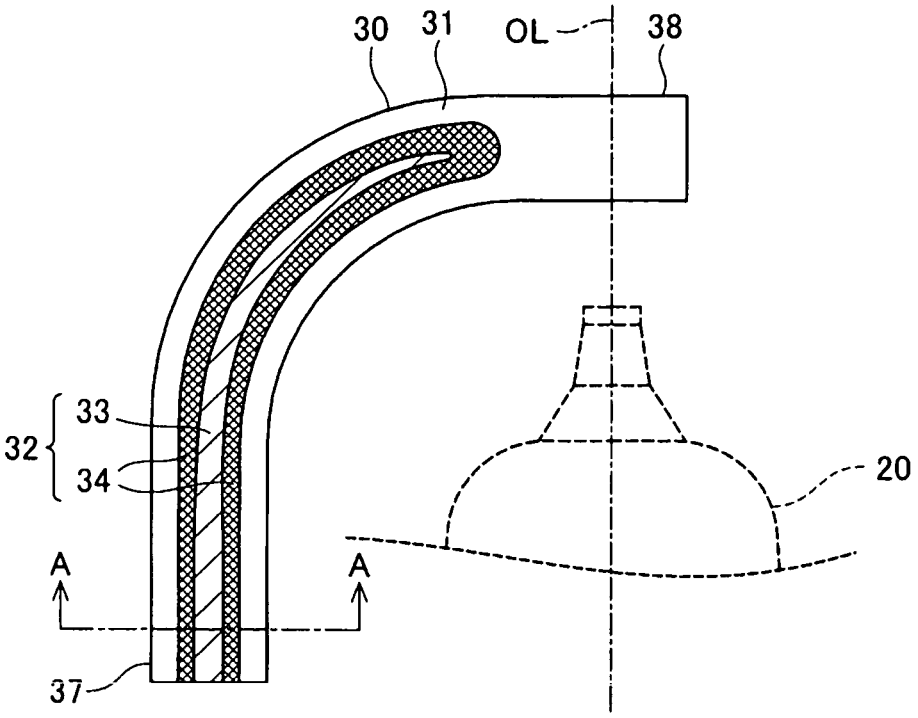
FIG. 2 is an explanatory view showing the specific structure of a ground electrode 30.
Figure 3:
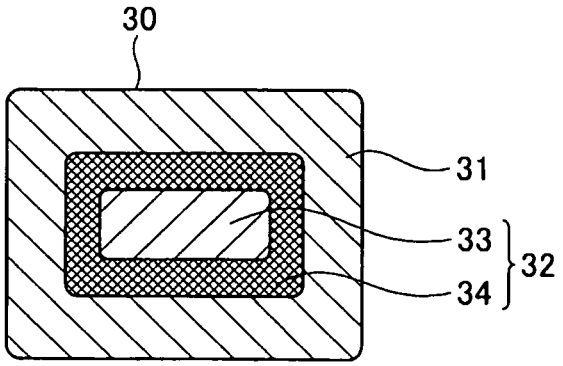
FIG. 3 is an explanatory view showing the specific structure of the ground electrode 30.

FIGS. 2 and 3 are explanatory views showing the specific structure of the ground electrode 30. FIG. 2 shows a cross section of the ground electrode 30, and FIG. 3 shows a cross section taken along line A-A of FIG. 2. As shown in FIG. 3, the cross-sectional shape of the ground electrode 30 is approximately rectangular. Also, as shown in FIGS. 2 and 3, in the present embodiment, the ground electrode 30 has a structure in which the cladding 31 covers the core 32. The core 32 is composed of a first core portion 33 and a second core portion 34 covering the first core portion 33. In the present embodiment, the cladding 31 is formed of a nickel alloy which contains nickel as a main component. The second core portion 34 of the core 32 is formed of copper or an alloy which contains copper as a main component, and the first core portion 33 of the core 32 is formed of a nickel alloy which contains nickel as a main component. The second core portion 34 improves the heat conductivity of the ground electrode 30, and the first core portion 33 improves the bendability of the ground electrode 30.

A-2. A Method for Manufacturing Ground Electrodes for the Spark Plug

Figure 4:
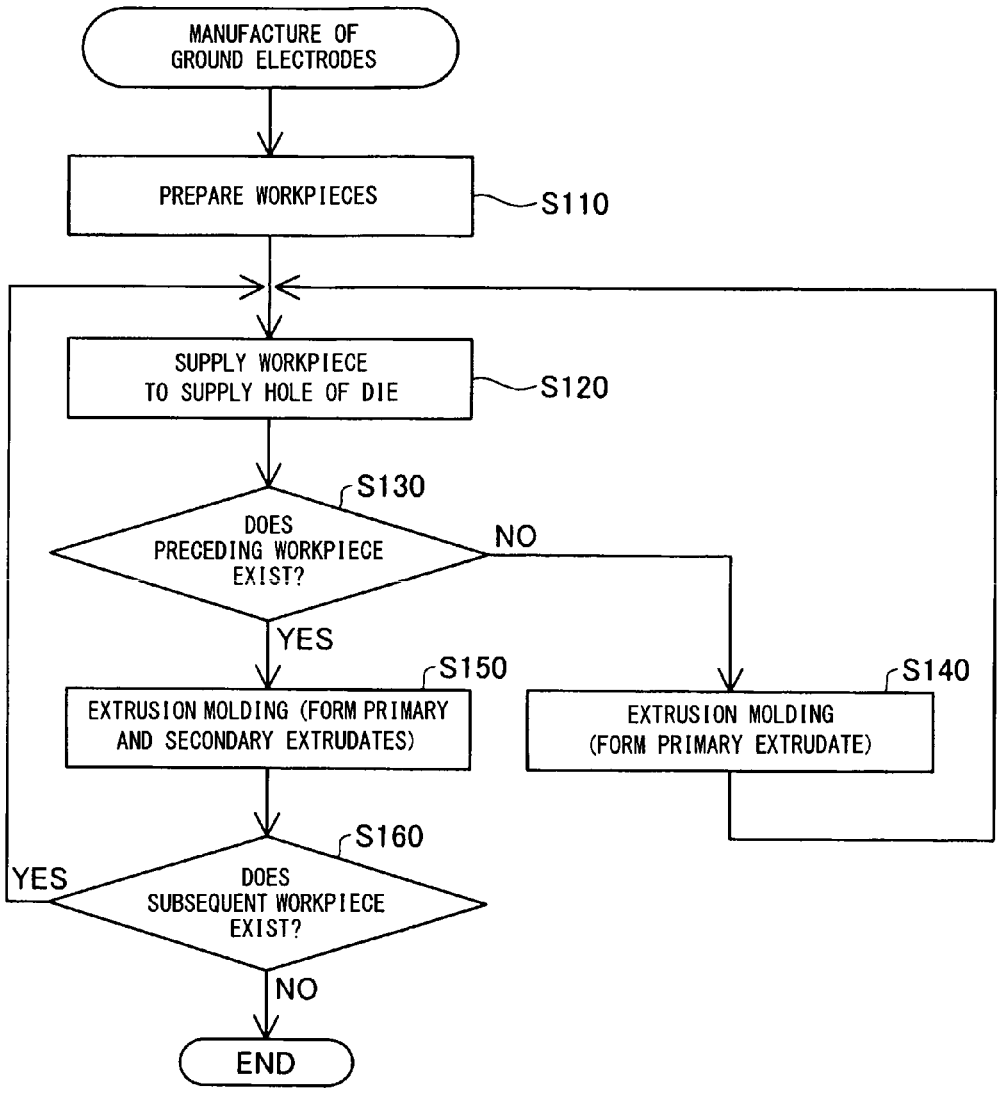
FIG. 4 is a flowchart showing a method for manufacturing the ground electrode 30 according to the present embodiment.
Figure 5:
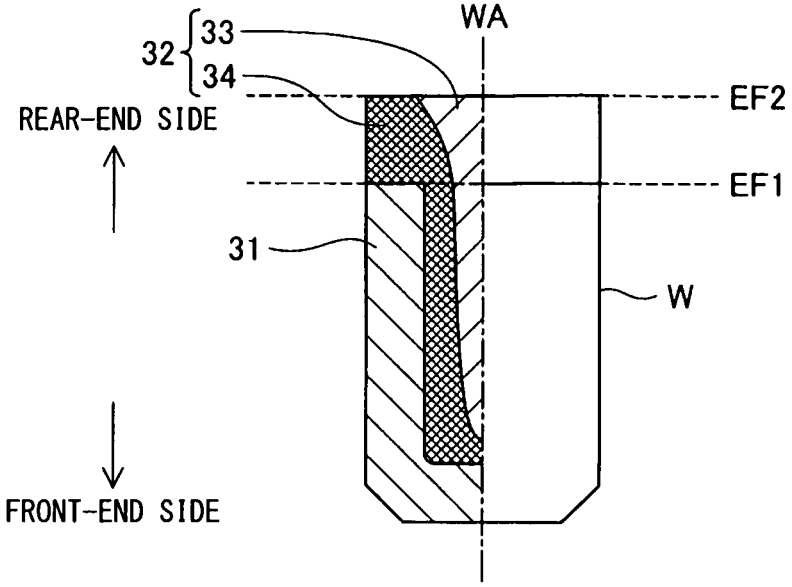
FIG. 5 is an explanatory view showing the structure of a workpiece W used for manufacturing the ground electrode 30 of the present embodiment.

FIG. 4 is a flowchart showing a method for manufacturing the ground electrode 30 according to the present embodiment. When the ground electrode 30 is manufactured, first, a workpiece (starting member) W is prepared (step S110). FIG. 5 is an explanatory view showing the structure of the workpiece W used for manufacture of the ground electrode 30 of the present embodiment. In FIG. 5, an external view of the workpiece W is illustrated on the right side of a workpiece axis WA, which is the center axis of the workpiece W, and a cross-sectional view of the workpiece W is illustrated on the left side of the workpiece axis WA.

The workpiece W is generally formed into a cylindrical column whose center coincides with the workpiece axis WA. In the following description, the side toward one end of the workpiece W along the workpiece axis WA will be referred to as the front-end side, and the side toward the opposite end thereof will be referred to as the rear-end side. Since the ground electrode 30 of the present embodiment is composed of the cladding 31 and the core 32 (the first core portion 33 and the second core portion 34) as described above, the workpiece W is also composed of a cladding 31 and a core 32 (a first core portion 33 and a second core portion 34). That is, the workpiece W has a structure in which the cladding 31 covers the core 32, and the second core portion 34 covers the first core portion 33. Notably, as shown in FIG. 5, the cladding 31 covers the core 32 on the front-end side of the workpiece W. However, the core 32 is not covered by the cladding 31 and is exposed on the rear-end side of the workpiece W. An end face EF2 of the core 32 on the rear-end side thereof is located rearward of an end face EF1 of the cladding 31 on the rear-end side thereof. The core 32 (the second core portion 34 thereof) forms a circumferential surface of the workpiece W in a region between the end face EF1 of the cladding 31 and the end face EF2 of the core 32. Notably, since a method of manufacturing the workpiece W having a triple layer structure shown in FIG. 5 is well known as described in, for example, Japanese Patent Application Laid-Open (kokai) No. H4-294085, description of the manufacturing method is not provided herein.

Figure 6A:
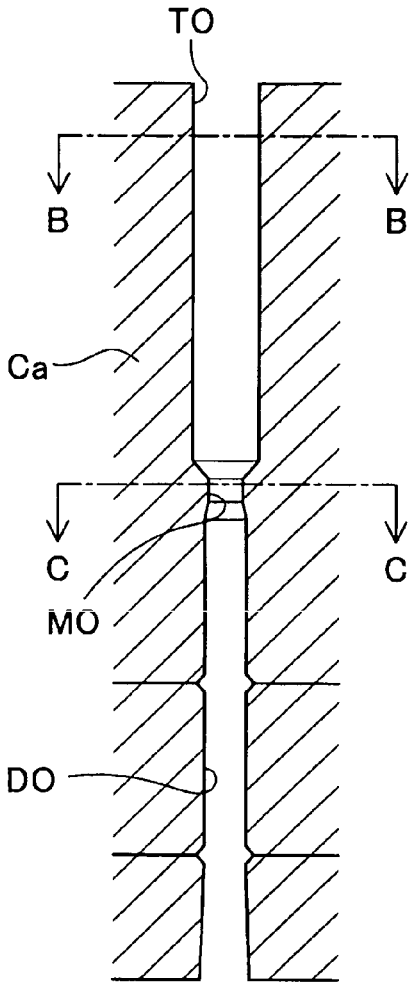
FIGS. 6A to 6C are explanatory views showing a die Ca for extrusion forming used for manufacturing the ground electrode 30 of the present embodiment.
Figure 6B:
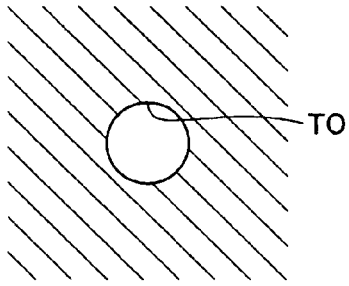
Figure 6C:
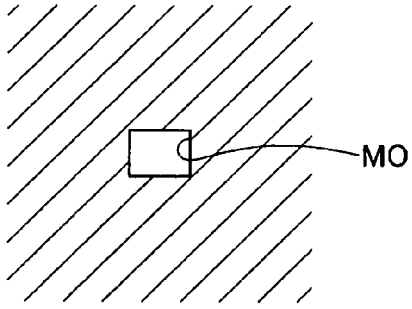

Next, a first workpiece W is supplied to a die Ca for extrusion forming (step S120 of FIG. 4). FIGS. 6A to 6C are explanatory views showing the structure of the die Ca for extrusion forming used for manufacture of the ground electrode 30 of the present embodiment. FIG. 6A shows a cross section of the die Ca. As shown in FIG. 6A, the die Ca has a supply hole TO, an extrusion hole MO adjacent to the supply hole TO, and a discharge hole DO adjacent to the extrusion hole MO. The supply hole TO, the extrusion hole MO, and the discharge hole DO have respective center axes which are approximately aligned with one another. FIG. 6B shows a cross section of the supply hole TO (a cross section taken along line B-B of FIG. 6A). FIG. 6C shows a cross section of a portion of the extrusion hole MO which has the smallest cross section (hereinafter this portion will be referred to as the "smallest cross section portion") (a cross section taken along line C-C of FIG. 6A). The smallest cross section portion of the extrusion hole MO has a cross-sectional shape which corresponds to that of the ground electrode 30 (see FIG. 3), and, in the present embodiment, is approximately rectangular as shown in FIG. 6C. Meanwhile, the supply hole TO has a cross-sectional shape which corresponds to that of the workpiece W, and, in the present embodiment, is approximately circular as shown in FIG. 6B. The cross section of the supply hole TO is greater than that of the smallest cross section portion of the extrusion hole MO. The extrusion hole MO has a taper portion which connects together the supply hole TO and the smallest cross section portion of the extrusion hole MO. Notably, the cross section of the discharge hole DO has an arbitrary shape, and is greater than that that of the smallest cross section portion of the extrusion hole MO. The extrusion hole MO also has a taper portion which connects together the discharge hole DO and the smallest cross section portion of the extrusion hole MO.

Figure 7A:
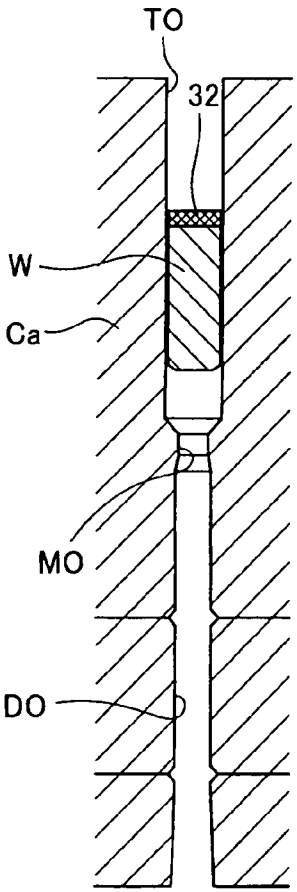
FIGS. 7A to 7D are explanatory views showing an extrusion forming method for manufacture of the ground electrode 30 according to the present embodiment.

FIGS. 7A to 7D are explanatory views showing the extrusion forming method for manufacture of the ground electrode 30 according to the present embodiment. FIG. 7A shows a state in which the first workpiece W has been supplied to the supply hole TO of the die Ca for extrusion forming. As shown in FIG. 7A, the workpiece W is supplied to the supply hole TO of the die Ca along a direction parallel to the workpiece axis WA with the front end (the end covered by the cladding 31, see FIG. 5) of the workpiece W being at the head.

Figure 7B:
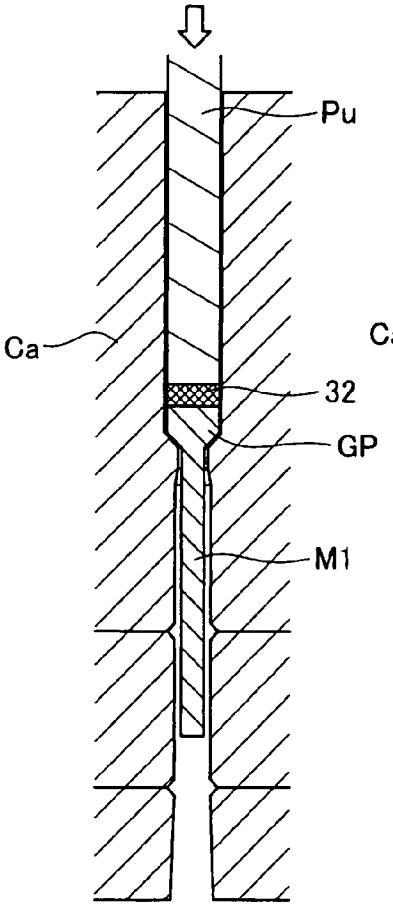

As shown in FIG. 7A, when the first workpiece W is supplied to the supply hole TO of the die Ca, no preceding workpiece exists. The preceding workpiece refers to a workpiece W which has been supplied into the die Ca previously. In the case where no preceding workpiece exists (step S130 of FIG. 4: NO), extrusion forming is performed after the supply of the workpiece W, whereby a primary extrudate M1 is formed (step S140). FIG. 7B shows a state in which the workpiece W supplied to the supply hole TO has been pushed into the extrusion hole MO by a punch Pu, whereby the primary extrudate M1 having a portion which has a cross-sectional shape corresponding to that of the extrusion hole MO has been formed. Notably, the primary extrudate M1 is an extrudate formed through extrusion of the supplied workpiece W. As shown in FIG. 7B, the portion of the primary extrudate M1 which has a cross-sectional shape corresponding to that of the extrusion hole MO is located within the discharge hole DO. However, since the cross section of the supply hole TO is larger than that of the extrusion hole MO, the endmost portion of the workpiece W remains within the supply hole TO even after the extrusion forming is completed and the primary extrudate M1 is formed, and forms a flange portion GP which is greater in cross section than the portion having passed through the extrusion hole MO. Also, since the core 32 is exposed from the rear end of the workpiece W, in the primary extrudate M1 as well, the core 32 is exposed from the rear end thereof.

Figure 7C:
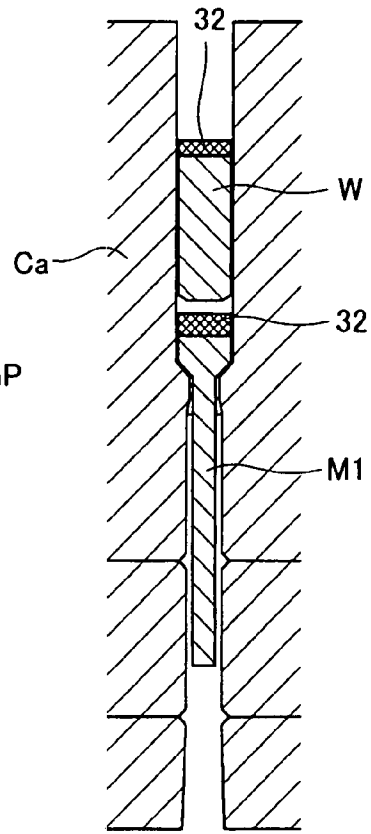

After step S140 of FIG. 4, the process returns to step S120, and a subsequent workpiece W is supplied to the supply hole TO of the die Ca for extrusion forming. FIG. 7C shows a state in which the subsequent workpiece W has been supplied to the supply hole TO of the die Ca. In this way, in the present embodiment, each workpiece W is supplied such that the workpiece W forms a vertical line with the primary extrudate M1, which is a workpiece W supplied and formed previously. The front end of the newly supplied workpiece W faces the core 32 of the primary extrudate M1 exposed from the rear end thereof.

Figure 7D:
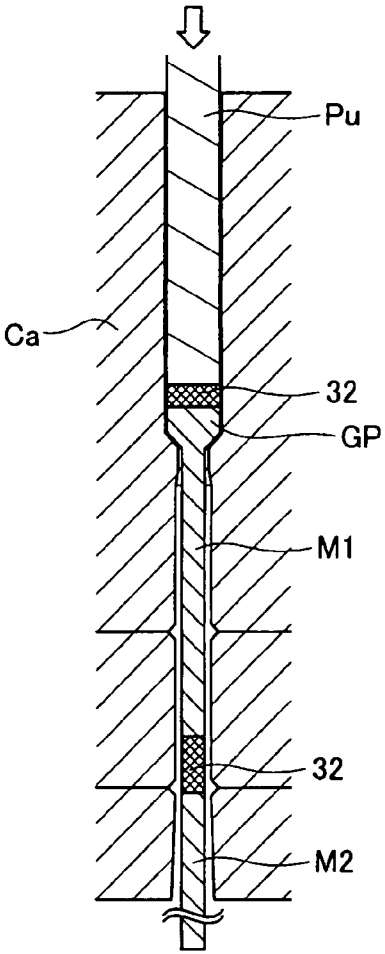

As shown in FIG. 7C, when a second or subsequent workpiece W is supplied to the supply hole TO of the die Ca, the preceding workpiece (that is, the primary extrudate M1) exists. When a preceding workpiece exists (step S130: YES), as a result of performance of extrusion forming after the supply of the workpiece W, another primary extrudate M1 and a secondary extrudate M2 are formed (step S150). That is, the primary extrudate M1 is pushed through the extrusion hole MO via the workpiece W, supplied to the supply hole TO, so as to form a secondary extrudate M2, and the workpiece W is pushed through the extrusion hole MO so as to form another primary extrudate M1. FIG. 7D shows a state in which the primary extrudate M1 has been pushed through the extrusion hole MO via the workpiece W, supplied to the supply hole TO, so as to form a secondary extrudate M2, and the workpiece W has been pushed through the extrusion hole MO by the punch Pu so as to form another primary extrudate M1. The secondary extrudate M2 is an extrudate formed by pushing the primary extrudate M1 through the extrusion hole MO via the workpiece W. Specifically, the secondary extrudate M2 is an extrudate obtained through extrusion forming performed on the rear end portion (the flange portion GP) of the primary extrudate M1, which portion is located rearward of the extrusion hole MO when the formation of the primary extrudate M1 is completed. Since the secondary extrudate M2 is formed as a result of the entire workpiece having passed through the extrusion hole MO, all portions of the secondary extrudate M2 have a cross-sectional shape corresponding to that of the extrusion hole MO. Also, since the core 32 of the primary extrudate M1 is exposed from the rear end thereof, in the secondary extrudate M2 as well, the core 32 is exposed from the rear end thereof. The front end of the newly formed primary extrudate M1 comes into contact with the core 32 of the secondary extrudate M2 exposed from the rear end thereof.

When a subsequent workpiece W exists (step S160: YES), the process of manufacturing the ground electrode 30 (FIG. 4) is continued. That is, the process returns to step S120, and the subsequent workpiece W is supplied to the supply hole TO of the die Ca for extrusion forming. Since a preceding workpiece exists, the supply of the workpiece W, formation of the primary extrudate M1 and the secondary extrudate M2 through extrusion forming, and cutting of the secondary extrudate M2 are performed. After that, this operation is repeated until it is determined that no subsequent workpiece W exists (step S160: NO).

Figure 8:
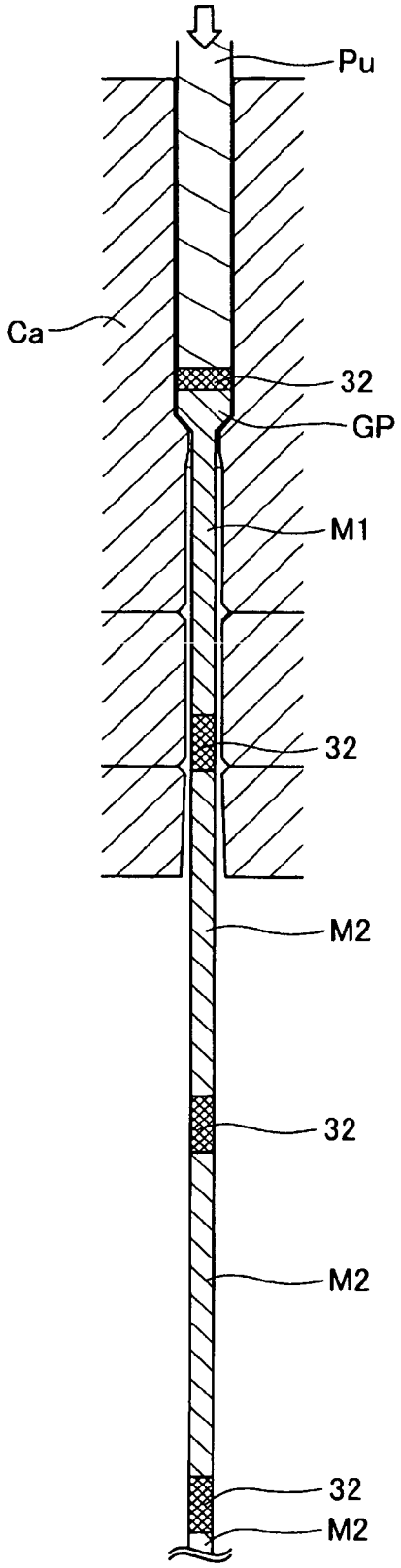
FIG. 8 is an explanatory view showing the extrusion forming method for manufacture of the ground electrode 30 according to the present embodiment.

Notably, when a plurality of secondary extrudates M2 are formed as shown in FIG. 8, a subsequent primary extrudate M1 and the plurality of secondary extrudates M2 are separated from each other at a position corresponding to a portion of the core 32 located therebetween. Subsequently, the plurality of secondary extrudates M2 are separated from one another. After that, a rear end portion of each secondary extrudate M2 from which the core 32 is exposed is cut and removed, whereby the ground electrode 30 is obtained. An end surface of the ground electrode 30 formed as a result of the cutting serves as a joint surface through which the ground electrode 30 is joined to the metallic shell 50. The formed ground electrode 30 is joined to the front end surface 57 of the metallic shell 50, and is bent such that the distal end portion 38 of the ground electrode 30 faces the distal end portion of the center electrode 20. As a result, the spark plug 100 shown in FIGS. 1 and 2 is completed.

Instead of cutting a plurality of secondary extrudates M2 together, the secondary extrudates may be cut on an extrudate-by-extrudate basis. Specifically, every time a single secondary extrudate M2 is formed, the secondary extrudate M2 may be separated from the primary extrudate M1, and undergo cutting work.

Figure 9:
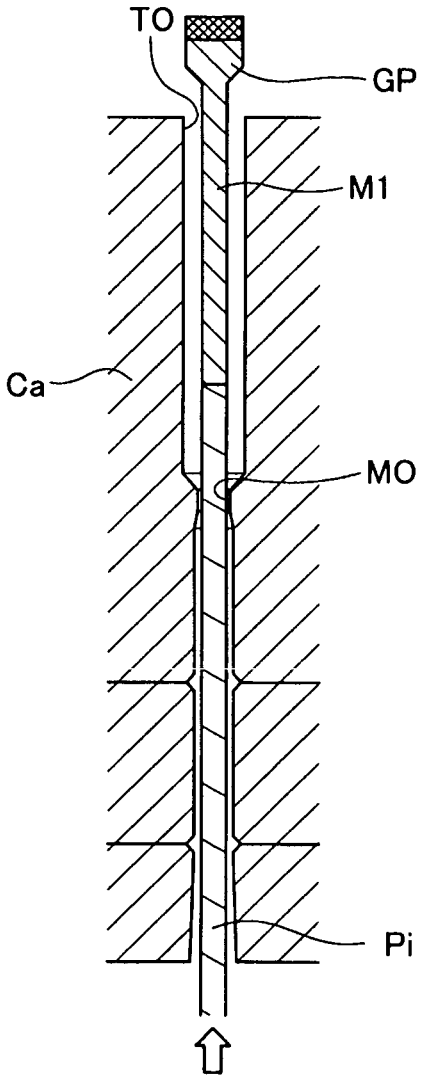
FIG. 9 is an explanatory view showing an extrusion forming method for manufacture of the ground electrode 30 according to a comparative example.

As described above, in the method for manufacturing the ground electrode 30 according to the present embodiment, since a plurality of workpieces W are supplied such that the workpieces W form a vertical line in the die Ca for extrusion forming, manufacturing time can be shortened. FIG. 9 is an explanatory view showing an extrusion forming method for manufacture of the ground electrode 30 according to a comparative example. In the comparative example, the ground electrode 30 is manufactured as follows. After a workpiece W supplied to the supply hole TO of the die Ca is subjected to extrusion forming so as to produce a primary extrudate M1 (see FIG. 7B), as shown in FIG. 9, the primary extrudate M1 is ejected by a pin Pi toward the inlet opening of the supply hole TO (the opening of the supply hole TO opposite the side toward the extrusion hole MO). After that, the flange portion GP of the discharged primary extrudate M1 is cut, whereby the ground electrode 30 is obtained. After that, supply of a workpiece W, formation of a primary extrudate M1 through extrusion forming, and ejection (discharge) of the primary extrudate M1 by the pin Pi are performed for each workpiece W. Therefore, the method for manufacturing the ground electrode 30 according to the comparative example requires a long manufacturing time. In the case of the method for manufacturing the ground electrode 30 according to the present embodiment, since a plurality of workpieces W are supplied such that the workpieces W form a vertical line in the die Ca for extrusion forming, manufacturing time can be shortened, as compared with the case of the comparative example.

Also, in the method for manufacturing the ground electrode 30 according to the present embodiment, each primary extrudate M1, which is a workpiece W having been supplied and having undergone extrusion forming previously, is pushed through the extrusion hole MO via another workpiece W supplied subsequently, whereby extrusion forming is performed on the flange portion GP of the primary extrudate M1. Thus, a secondary extrudate M2 is formed. Since the formed secondary extrudate M2 does not have the flange portion GP, at the time of cutting work, only a rear end portion of the secondary extrudate M2 from which the core 32 is exposed is required to be removed through cutting. Therefore, as compared with the manufacturing method of the comparative example which requires cutting of the flange portion GP, the manufacturing method of the present embodiment can reduce waste of material, and can realize reduction of manufacturing cost. Also, in the manufacturing method of the present embodiment, since each primary extrudate M1 is pushed via a workpiece W through the extrusion hole MO, the length of the punch Pu is not required to increase for the operation of pushing the primary extrudate M1 through the extrusion hole MO, and a punch identical with the punch Pu used in the comparative example shown in FIG. 9 can be used. Therefore, the manufacturing method of the present embodiment can prevent decrease in the rigidity and service life of the punch Pu, which decrease would otherwise occur when the length of the punch Pu is increased.

Also, as shown in FIG. 5, each of the workpieces W used for manufacture of the ground electrode 30 according to the present embodiment includes the core 32 and the cladding 31, which covers the core 32, and the end face EF2 of the core 32 located on the rear-end side of the workpiece W is exposed from the end face EF1 of the cladding 31. Therefore, each secondary extrudate M2 formed through extrusion forming comes into contact with the front end of a simultaneously formed primary extrudate M1 via the end face of the core 32. Accordingly, in the manufacturing method of the present embodiment, biting between the secondary extrudate M2 and the primary extrudate M1 caused by extrusion forming can be mitigated, and separation between the secondary extrudate M2 and the primary extrudate M1 (separation at the time of removal of the secondary extrudate M2) can be readily performed.

Also, in the method for manufacturing the ground electrode 30 according to the present embodiment, since each extrudate is discharged from the discharge hole DO of the die Ca, it is unnecessary to eject (kick out) each extrudate toward the inlet opening of the supply hole TO by the pin Pi as in the case of the comparative example shown in FIG. 9. Therefore, the manufacturing method of the present embodiment can prevent occurrence of problems associated with the extrudate (scraping of the surface, and biting against the pin Pi), which would otherwise occur at the time of ejection. In addition, the jig (the pin Pi) can be eliminated. Also, in the case of the manufacturing method of the comparative example, lubrication treatment is frequently performed for the workpieces W and the die Ca for preventing occurrence of problems associated with ejection of the extrudate. In contrast, in the case of the manufacturing method of the present embodiment, since ejection (kicking out operation) is not performed, such lubrication treatment is not required. Therefore, reduction in manufacturing time and manufacturing cost can be realized.

B. Modifications

Notably, the present invention is not limited to the above-described example and embodiment, and may be practiced in various forms without departing from the scope of the invention. For example, the below modifications are possible.

The structure of the spark plug 100 according to the above-described embodiment and the structure of the ground electrode 30, which is a component thereof, are mere examples, and may be modified in various manners. For example, in the above-described embodiment, the ground electrode 30 has a triple layer structure (that is, is comprised of the cladding 31, the first core portion 33, and the second core portion 34). However, the structure of the ground electrode 30 is not limited thereto, and the ground electrode 30 may have a single layer structure or a double layer structure, or may be composed of four or more layers. The materials of the layers of the ground electrode 30 are not limited to those described in the above-described embodiment. Needless to say, the structure and material of the workpiece W, which is a starting material used for manufacture of the ground electrode 30, are also not limited to those described in the above-described embodiment.

Figure 10A:
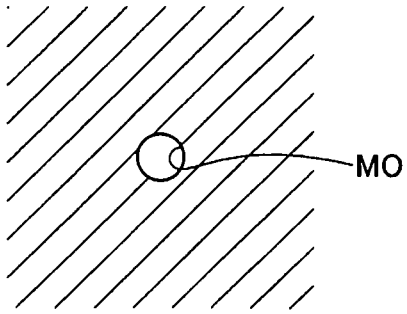
FIGS. 10A to 10C are explanatory views showing modifications of the cross-sectional shape of an extrusion hole MO of the die Ca.
Figure 10B:
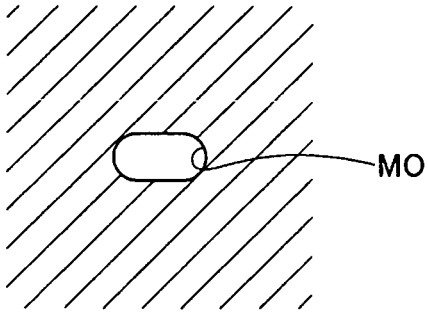
Figure 10C:
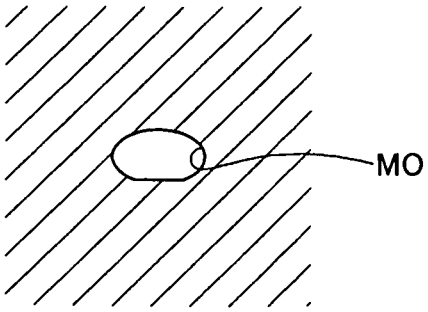

In the above-described embodiment, the cross-sectional shape of the ground electrode 30 is rectangular. However, the cross-sectional shape of the ground electrode 30 is not limited thereto, and the ground electrode 30 may have a circular cross section or a cross section corresponding to one of two sections of a flat oval, a circle, or an ellipse, which sections are obtained by dividing the flat oval, circle, or ellipse by a straight line. Notably, the smallest cross section portion of the extrusion hole MO of the die Ca has a cross-sectional shape corresponding to that of the ground electrode 30. FIGS. 10A to 10C are explanatory views showing modifications of the cross-sectional shape of the extrusion hole MO of the die Ca. In the case where the ground electrode 30 has an approximately circular cross section, as shown in FIG. 10A, the smallest cross section portion of the extrusion hole MO of the die Ca has a generally circular cross-sectional shape corresponding thereto. Similarly, in the case where the ground electrode 30 has a cross section corresponding to one of two sections of a flat oval, a circle, or an ellipse, which sections are obtained by dividing the flat oval, circle, or ellipse by a straight line, as shown in FIGS. 10B and 10C, the smallest cross section portion of the extrusion hole MO of the die Ca has a cross-sectional shape corresponding thereto.

Notably, in the case where the extrusion hole MO has a non-circular cross section; that is, a cross section determined such that the distance OA between the centroid O of the cross section and a point A on the circumference of the cross section differs from the distance OB between the centroid O and a point B which is located on the circumference of the cross section and differs from the point A, the above-described problems associated with ejection of extrudates becomes more likely to occur. In the case of the manufacturing method of the present embodiment, even when a die Ca which is likely to cause problems associated with ejection of extrudates is used, occurrence of problems can be avoided without performing lubrication treatment or the like, and the degree of freedom in designing the cross section of the ground electrode 30 can be increased.

Figure 11:
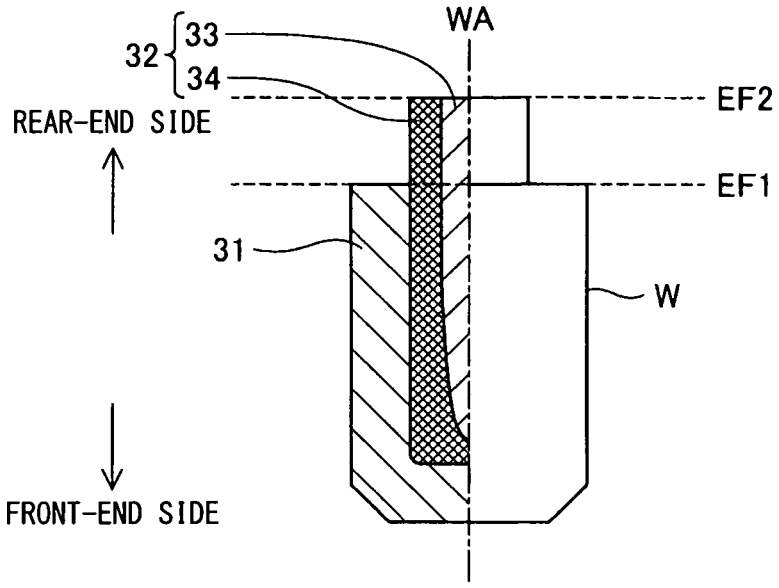
FIG. 11 is an explanatory view showing a modification of the structure of the workpiece W.

In the above-described embodiment, each workpiece W has an approximately columnar cylindrical shape and has a substantially constant diameter over the entire length thereof. However, as shown in FIG. 11, each workpiece W may be formed such that the diameter on the rear-end side thereof is smaller than that on the front-end side thereof.

In the above-described embodiment, each workpiece W is supplied to the supply hole TO of the die Ca from the side where the workpiece W is covered by the cladding 31. However, each workpiece W may be supplied to the supply hole TO of the die Ca from the opposite side (the side where the core 32 is exposed). In this case, the core 32 can be prevented from narrowing on the front-end side. In the above-described embodiment, a plurality of workpieces W are supplied such that the workpieces W form a vertical line in the die Ca. However, the embodiment may be modified such that a different member is disposed between a workpiece W supplied previously and a workpiece W supplied subsequently. In the above-described embodiment, each primary extrudate M1 is pushed through the extrusion hole MO via a workpiece W supplied subsequently, whereby extrusion forming is performed for a portion (flange portion GP) of the primary extrudate M1. However, the embodiment may be modified such that a primary extrudate M1 is pushed out via a workpiece W supplied in an operation cycle after the next operation cycle. That is, in the case where a workpiece W supplied to the supply hole TO of the die Ca in an n-th operation cycle (n is a natural number) is referred to as an n-th workpiece and a workpiece W supplied to the supply hole TO of the die Ca in an m-th operation cycle (m is a natural number, and m>n) is referred to as an m-th workpiece, the n-th workpiece is pushed through the extrusion hole MO via the m-th workpiece, whereby extrusion forming is effected on at least a portion of the n-th workpiece. In the above-described embodiment, each extrudate is discharged from the discharge hole DO of the die Ca. However, the embodiment may be modified such that, after formation of a primary extrudate M1 and a secondary extrudate M2, they are ejected together toward the inlet opening of the supply hole TO, insofar as a plurality of workpieces W are supplied such that the workpieces W form a vertical line in the die Ca for extrusion forming.

The present invention can be applied not only to the method of manufacturing the ground electrode 30, but also to the method of manufacturing the center electrode 20.

Among constituent elements of the present invention mentioned in the above-described embodiment, constituent elements other than those claimed in an independent claim are additional ones and can be eliminated or combined as appropriate.

DESCRIPTION OF REFERENCE NUMERALS

3: ceramic resistor
4: seal body
5: gasket
10: insulator
12: axial bore
13: leg portion
17: front trunk portion
18: rear trunk portion
19: center trunk portion
20: center electrode
21; cladding
25: core
30: ground electrode
31: cladding
32: core
33: first core portion
34: second core portion
37: proximal end portion
38: distal end portion
40: metal terminal
50: metallic shell
51: tool engagement portion
52: screw portion
54: seal portion
57: front end surface
100: spark plug Having described the invention, the following is claimed:

1. A method for manufacturing electrodes for a spark plug comprising:

a supply step of supplying a plurality of workpieces to a die for extrusion forming, wherein each workpiece is a material of an electrode and includes a core and a cladding that covers at least a portion of the surface of the core, said die having (i) an extrusion hole for forming the workpiece to have a predetermined cross sectional shape, and (ii) a supply hole located adjacent to the extrusion hole, said supply hole having a cross section greater than a cross section of the extrusion hole, wherein at one end of each workpiece along a direction parallel to a direction in which each workpiece is supplied to the supply hole, an end face of the core is exposed from an end face of the cladding; and a forming step of pushing each workpiece, supplied to the supply hole, through the extrusion hole so as to form each workpiece into a shape corresponding to the cross section of the extrusion hole, wherein the supply step includes supplying the plurality of workpieces to the supply hole such that the plurality of workpieces form a vertical line in the die.

2. A method for manufacturing electrodes for a spark plug according to claim 1, wherein the forming step comprises a step of pushing an n-th workpiece via an m-th workpiece so as to perform extrusion forming on at least a portion of the n-th workpiece, the n-th workpiece being a workpiece supplied to the supply hole in an n-th operation cycle where n is a natural number, and the m-th workpiece being a workpiece supplied to the supply hole in an m-th operation cycle where m is a natural number greater than n.

3. A method for manufacturing electrodes for a spark plug according to claim 1, wherein, in the supply step, the workpiece is supplied to the die from the side where the core is exposed.

4. A method for manufacturing electrodes for a spark plug according to claim 1, wherein the workpiece subjected to the forming step is discharged from an opening of the extrusion hole opposite the supply hole.

5. A method for manufacturing electrodes for a spark plug according to claim 4, wherein the extrusion hole of the die has a cross section determined such that a distance OA between the centroid O of the cross section and a point A which is located on the circumference of the cross section differs from a distance OB between the centroid O and a point B which is located on the circumference of the cross section and differs from the point A.

6. A method for manufacturing a spark plug which includes a metallic shell and a ground electrode whose one end is attached to a front end of the metallic shell, the method comprising the steps of:

manufacturing the ground electrode through use of a method for manufacturing electrodes for a spark plug comprising:

a supply step of supplying a plurality of workpieces to a die for extrusion forming, wherein each workpiece is a material of an electrode and includes a core and a cladding that covers at least a portion of the surface of the core, said die having (i) an extrusion hole for forming the workpiece to have a predetermined cross sectional shape, and (ii) a supply hole located adjacent to the extrusion hole, said supply hole having a cross section greater than a cross section of the extrusion hole, wherein, at one end of the workpiece along a direction parallel to a direction in which the workpiece is supplied to the supply hole, an end face of the core is exposed from an end face of the cladding; and a forming step of pushing each workpiece, supplied to the supply hole, through the extrusion hole so as to form each workpiece into a shape corresponding to the cross section of the extrusion hole, wherein the supply step includes supplying the plurality of workpieces to the supply hole such that the plurality of workpieces form a vertical line in the die; and attaching the ground electrode to the metallic shell.

7. A method according to claim 1, wherein pushing a first workpiece through the extrusion hole forms the first workpiece into a first primary extrudate, and pushing a second workpiece through the extrusion hole simultaneously (i) forms the second workpiece into a second primary extrudate and (ii) forms the first workpiece into a first secondary extrudate in the die.

8. A method according to claim 7, wherein the pushing of the second workpiece through the extrusion hole causes one end of the second workpiece to contact one end of the first workpiece to thereby simultaneously form the second primary extrudate and the first secondary extrudate in the die.

9. A method according to claim 6, wherein pushing a first workpiece through the extrusion hole forms the first workpiece into a first primary extrudate, and pushing a second workpiece through the extrusion hole simultaneously (i) forms the second workpiece into a second primary extrudate and (ii) forms the first workpiece into a first secondary extrudate in the die.

10. A method according to claim 9, wherein the pushing of the second workpiece through the extrusion hole causes one end of the second workpiece to contact one end of the first workpiece to thereby simultaneously form the second primary extrudate and the first secondary extrudate in the die.

* * * * *